US005172426A

United States Patent [19]

Capello

[11] Patent Number: 5,172,426

[45] Date of Patent: Dec. 22, 1992

[54] PROTECTIVE, FIREPROOF OUTFIT

[75] Inventor: Giuseppe Capello, Turin, Italy

[73] Assignee: Prometeo S.p.A., Turin, Italy

[21] Appl. No.: 791,284

[22] Filed: Nov. 13, 1991

[51] Int. Cl.[5] ..... A41D 13/00

[52] U.S. Cl. ..... 2/81; 2/79; 2/7; 2/243 A; 2/97; 2/227

[58] Field of Search ..... 2/81, 7, 79, 243 A, 2/97, 227

[56] References Cited

U.S. PATENT DOCUMENTS

| | | | |
|---|---|---|---|
| 2,627,072 | 2/1953 | Frommelt | 2/2 |
| 4,805,244 | 2/1989 | Scott | 2/81 |
| 4,843,646 | 7/1989 | Grilliot et al. | 2/69 |
| 4,890,336 | 1/1990 | Worton | 2/81 |
| 4,897,886 | 2/1990 | Grilliot et al. | 2/81 |
| 4,922,552 | 5/1990 | Grilliot et al. | 2/81 |
| 5,001,781 | 3/1991 | Grilliot et al. | 2/81 |
| 5,031,242 | 7/1991 | Aldridge et al. | 2/81 |

FOREIGN PATENT DOCUMENTS

| | | | |
|---|---|---|---|
| 2561930 | 10/1985 | France | 2/69 |

*Primary Examiner*—Werner H. Schroeder
*Assistant Examiner*—Gloria Hale
*Attorney, Agent, or Firm*—Sughrue, Mion Zinn Macpeak & Seas

[57] ABSTRACT

A protective fireproof outfit includes an overall garment in combination with an undershirt and hood. The overall garment is comprised of an outer fabric layer of fireproof yarn and a plurality of mesh liner portions sewn in the outer layer in those areas requiring greater protection. At least one layer of netting and one or more additional layers of lining may also be secured in areas requiring greater protection. The lining material is also made of fireproof yarn and all layers of material are highly permeable to the passage of air to facilitate the transfer of heat. The hood and undershirt may also be of mesh fireproof material with selected lining portions of fireproof material, all of which are highly permeable to the passage of air.

4 Claims, 6 Drawing Sheets

PROTECTIVE, FIREPROOF OUTFIT

BACKGROUND OF THE DISCLOSURE

The present invention relates to a protective, fireproof outfit for activities which involve a risk of burns, for example, urban, industrial and forest fire-fighting activities, as well as industrial activities which are carried out in the presence of molten metal, combustibles or high voltages, military and police activities, and for use by drivers of motor vehicles, aircraft pilots, etc.

The invention results from studies and tests carried out by the Applicant in relation to the problem of safety in carrying out the activities identified above.

The Applicant has identified a set of basic principles (some of which are contrary to current technical thinking in this field) which must be satisfied in order to provide the best solution to the aforesaid problem.

A first important principle, the identification of which forms the basis of the present invention, lies in the fact that a safety outfit should be thought of as the combination of all the items of clothing which separate the skin of the person wearing the outfit from the outside environment. Although this finding may seem trivial, it has hitherto been completely ignored by designers in this sector. In fact, designers have limited themselves to providing an outer protective covering for the person without paying attention to the undergarments.

A second important principle which may also seem trivial at first sight but which has also always been ignored hitherto in the design of safety outfits is the need to provide an outfit which is comfortable to wear and is tolerable throughout the period during which it is in use. In other words, comfort should be considered to be a safety factor.

This is not only because an intolerable garment is not worn but also because the use of an outfit which is tiring to wear generally reduces the attentiveness of the person, whereas attentiveness is one of his main protections against accidents. Moreover, uncomfortable and heavy clothing which causes heavy perspiration helps to create the microclimatic conditions which favour heatstroke.

A further important consideration which should be taken into account in the design of safety outfits is that the classification of the seriousness of a burn depends not only—as has been thought up to now—on the extent and depth of the burn (outfits known up to now provided the same overall protection for all regions of the body) but, above all, on the part of the body which is damaged. Burns of even limited extent in functionally important regions of the body should be considered particularly serious both because they are difficult to cure and because of the incapacitating effects of their failure to recover. This principle is very innovative.

Yet another completely novel basic principle lies in the fact that a protective garment should not nullify the main natural defence which consists of the ability of the skin to feel high temperatures and thus to detect danger.

In other words it is wrong to consider the protection of a person by the provision of an outfit which insulates him as much as possible from the outside environment. In fact, in such an outfit, the person may be in a dangerous situation (for example, with a high ambient temperature) without realising it until there is so much heat that it is transmitted through the outfit very quickly and burns the person before he can escape. It is therefore necessary to ensure that the interval between the reaching of the pain threshold and the reaching of the threshold of irreversible damage is always longer than the person's reaction time.

A protective outfit should have characteristics which make it suitable for the specific situation in which it is used, that is, it should provide the intended protection to all regions of the body exposed to the risk.

Finally, the materials making up the outfit and its construction should of course be flame-proof.

SUMMARY OF THE INVENTION

In order simultaneously to satisfy all the requirements specified above, the subject of the present invention is a protective, fireproof outfit for activities involving a risk of burns, characterised by the following characteristics in combination: a) the outfit is constituted by several garments which are at least partially superposed to provide different degrees of protection to different regions of the body of the person wearing the outfit, b) the outfit has a small area of minimum protection in correspondence with at least one more heat-resistant region of the body of the person wearing the outfit, constituting a point where the outside temperature can be detected so that the person can become aware of the ambient temperature promptly, c) in the regions of greatest protection, as a result of the superposition of the various garments, the outfit has an outer layer of fireproof fabric superposed on at least one layer of mesh made of a fireproof yarn and at least one layer of net made of a fireproof yarn, the layers being formed so as to facilitate the transfer of heat from the outside environment to the skin of the person wearing the outfit by radiation but to keep to a minimum the transfer of heat by conduction.

The outfit according to the invention provides greater protection for the face, the hands, the flexing regions of the limbs, the wrists, the ankles and the perineum, that is, all the functionally important parts of the body. There is lesser protection for the volar regions of the limbs and the abdomen and, finally, even more limited protection for the remaining regions of the body. As already indicated above, these degrees of protection are achieved by the superposition of the various garments making up the outfit.

The provision of a point where the ambient temperature can be detected allows the person never unknowingly to enter a dangerous zone. In fact, the first sensation of pain caused by the heat occurs soon enough to enable the person to react and escape before the burning threshold is reached.

The provision of the fabric, mesh and net layers described above to facilitate the transmission of heat by radiation means that, when the external temperature is high, the temperature of the skin always increases progressively. This ensures that, in any case, the skin temperature always takes a period longer than the person's reaction time to rise to the burning temperature.

In order to ensure adequate comfort, particularly in hot climates, the outfit has a high degree of air-permeability which is almost the same in the regions with the greatest protection.

The outfit is constructed so that its components are not easily damaged and do not retain burning cinders but facilitate their sliding off. For example, the pockets are formed on the inside.

BRIEF DESCRIPTION OF THE DRAWINGS

Further characteristics and advantages of the invention will become clear from the description which follows with reference to a preferred embodiment which is intended specifically for use against forest fires and is shown by way of non-limiting example in the appended drawings, in which.

DETAILED DESCRIPTION OF THE INVENTION

The embodiment illustrated in the appended drawings relates to an outfit which is produced according to the principles explained above and can be used for forest fire-fighting. Naturally, the same principles can be applied to protective outfits for firemen, racing-car drivers, aircraft pilots, police officers, etc.

Figure 1:
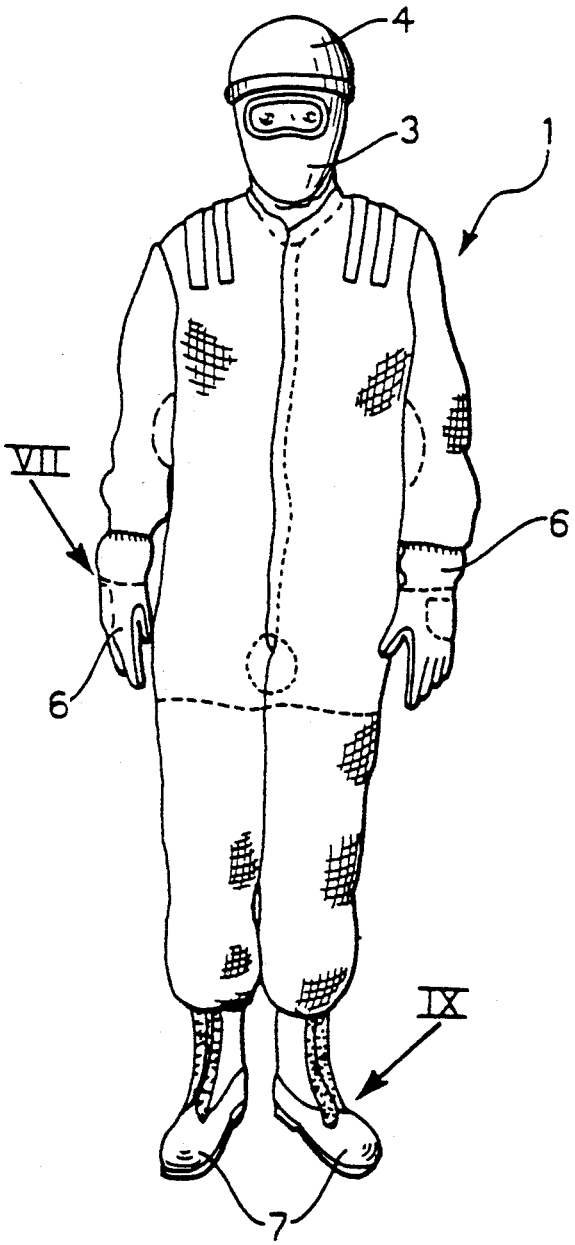
FIGS. 1 and 2 are a front view and rear view of the complete outfit.
Figure 2:
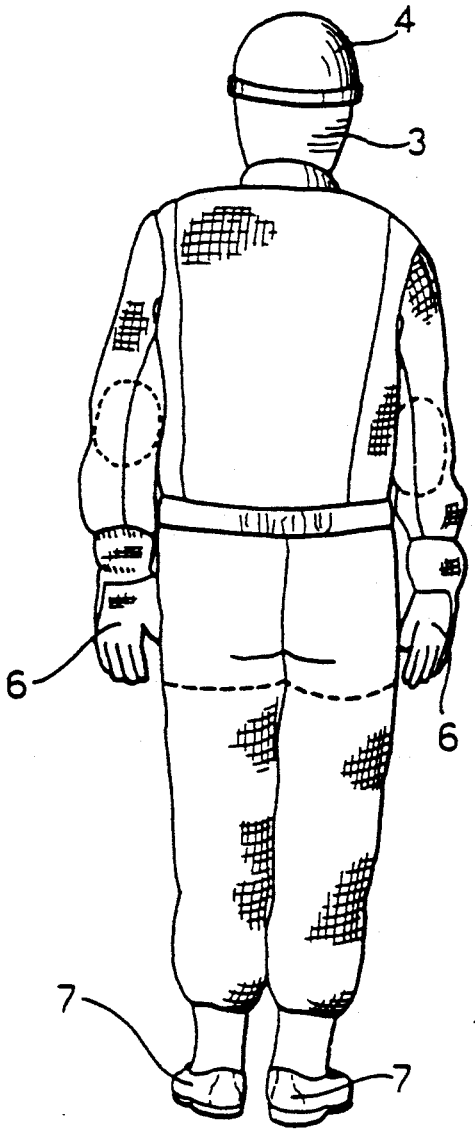

With reference to the appended drawings, the outfit according to the invention includes a plurality of at least partially superposed items of clothing. More precisely, the outfit includes an outer overall 1 which covers the person's entire body except for his head, hands and feet. Under the overall 1, the person wears a undershirt 2 (FIG. 5) which covers his torso and arms. His head and neck are protected by a hood 3 (FIGS. 5, 6) which leaves only the region of the eyes uncovered. A helmet 4 (FIGS. 1, 2; 11, 12) or a cap 5 (FIGS. 13–16) may be worn over the hood 3. His hands are protected by gloves 6 (FIGS. 1, 2; 7, 8) and his feet are protected by socks (not shown) and boots 7 (FIGS. 1, 2; 9; 10).

The fabric forming the overall 1 is made of a fireproof yarn. Fireproof yarn means a yarn made of a material with fireproof properties. In the present description and in the claims which follow, however, the term fireproof should be considered also to include fireproofed yarn, that is, a yarn made of a material which is not fireproof but which has been treated with substances which make it fireproof.

Figure 3:
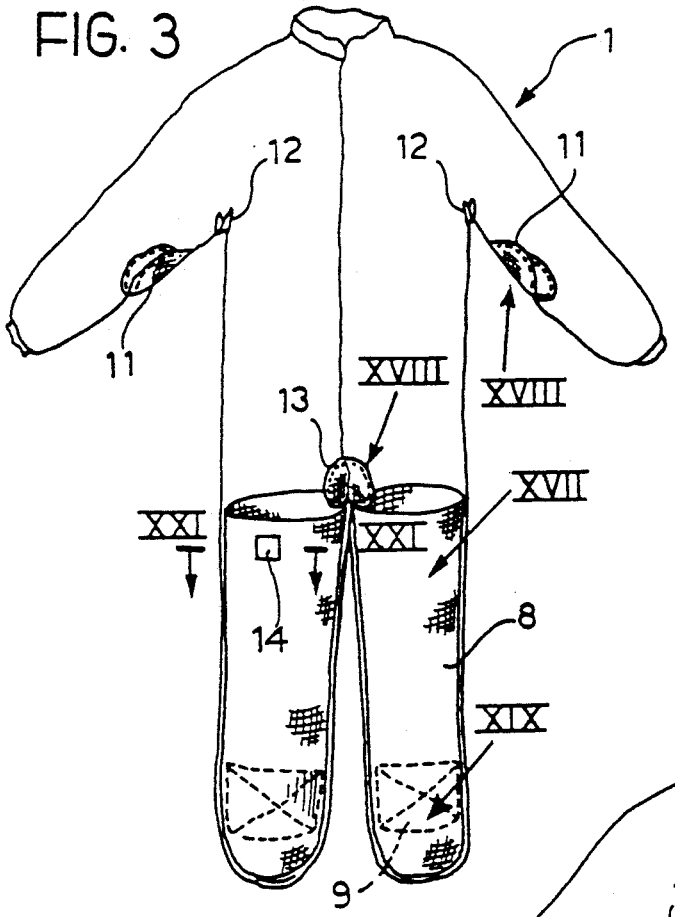
FIGS. 3 and 4 are further front and rear views showing the linings of the outfit.
Figure 4:
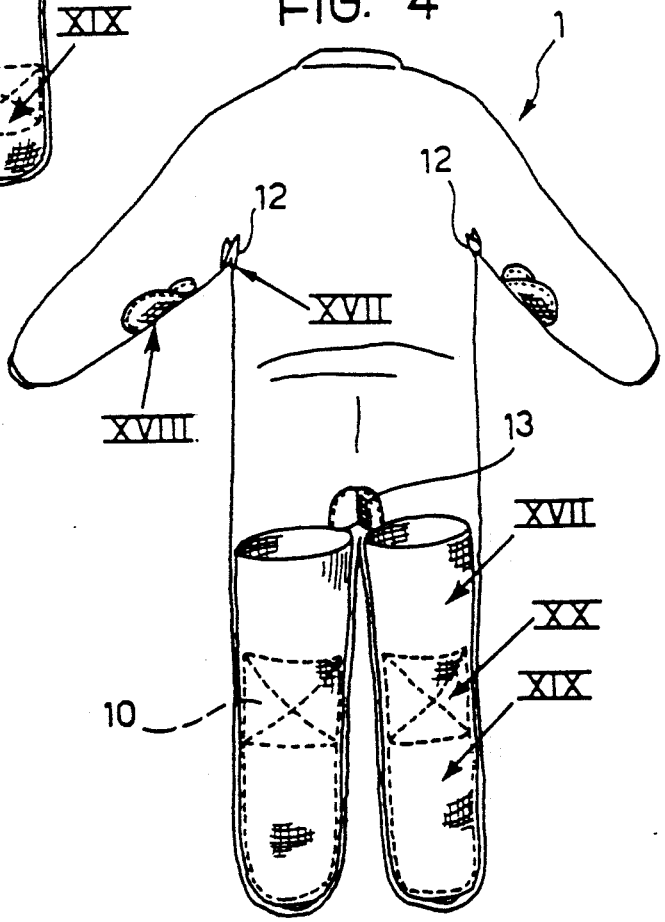
Figure 17:
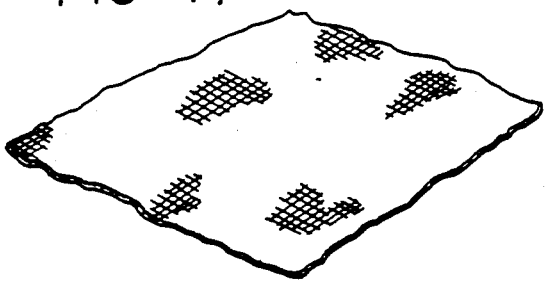
FIGS. 17–20 are perspective views showing the construction of the parts indicated by the arrows XVII, XVIII, XIV and XX in the preceding figures.

As shown in FIGS. 3 and 4, the legs of the overall 1 include a sewn-in mesh lining, also made of fireproof yarn (seen the arrow XVII), a piece of which is shown in perspective in FIG. 17. The legs of the person wearing the outfit are therefore protected by the self-extinguishing fireproof fabric of the overall 1 and of the mesh 8. There are additional protectors 9, 10, however, on the fronts of the lower legs and on the backs of the legs at knee level (FIGS. 3, 4). Each protector 9 has the structure shown in an exploded configuration in FIG. 19, including two layers of mesh 39, 40 between which is a net 44 of fireproof yarn. Each of the additional parts 10, however, has the structure shown in FIG. 20, including a mesh layer 50 superposed on a net layer 51, two further mesh layers 52, 53 and a further net layer 54.

Figure 18:
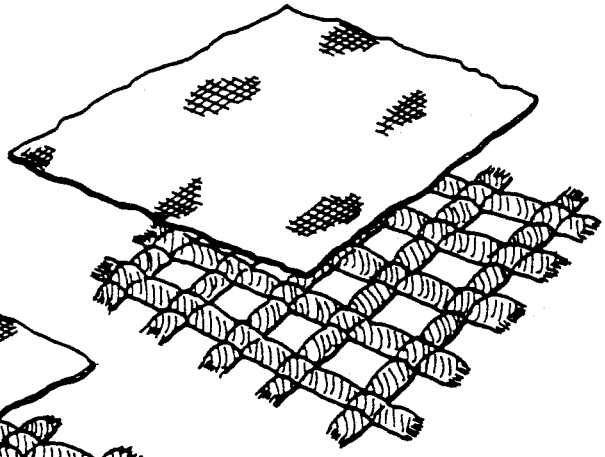

As shown in FIGS. 3 and 4, the overall 1 also has additional elbow protectors 11 having the structure shown in FIG. 18 (one layer of mesh 60 and one of net 61) additional armpit protectors 12 constituted by a single mesh layer 8 (FIG. 17) and a further additional protector 13 on the perineum having the structure illustrated in FIG. 18.

Figure 21:
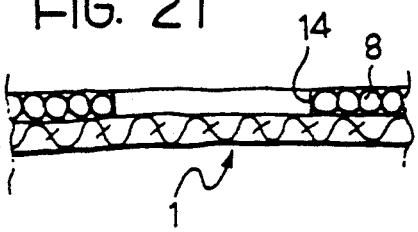
FIG. 21 is a section taken on the line XXI—XXI of FIG. 3.

On the front of one of the thighs, the mesh lining 8 has a hole 14 which creates a point where the outside temperature can be detected. In correspondence with the hole 14, the skin is separated from the outside environment only by the fabric of the overall 1, affording the advantages explained above (see also FIG. 21).

Figure 5:
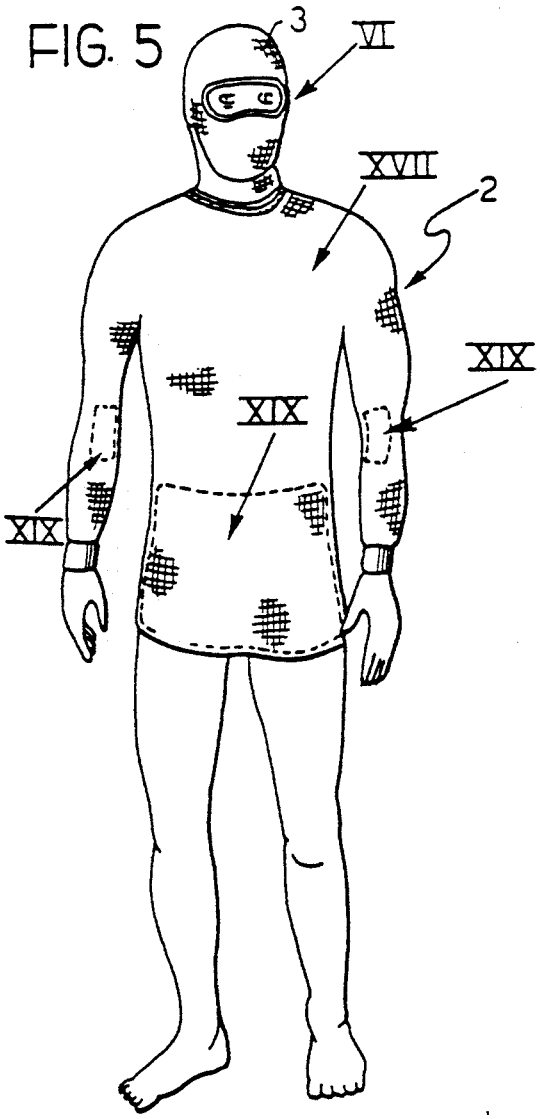
FIG. 5 shows the undershirt and the hood which form parts of the outfit according to the invention.

With reference to FIG. 5, most of the undershirt 2 is constituted by a single mesh layer of the type illustrated in FIG. 17. However, the regions which need most protection (the flexing parts of the arms and the abdomen) have the structure shown in FIG. 19 (as indicated by the arrows XIX in FIG. 5).

Figure 6:
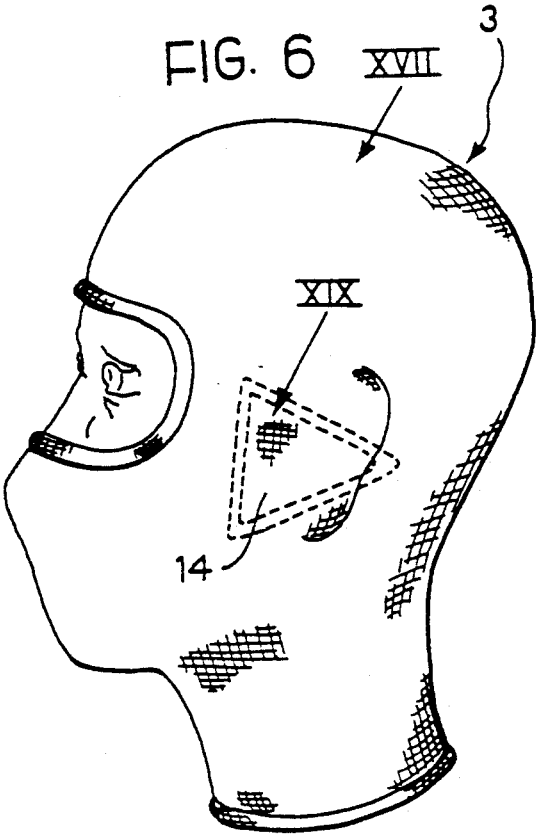
FIG. 6 is a side view of the hood.
Figure 7:
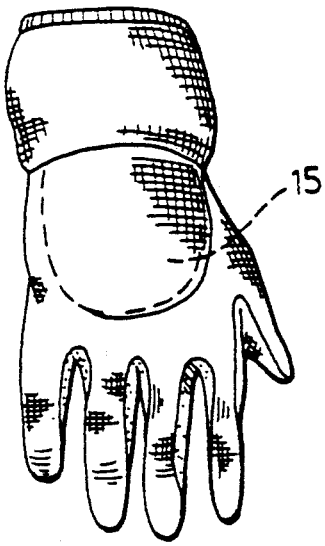
FIGS. 7 and 8 show a glove which forms part of the outfit according to the invention.
Figure 8:
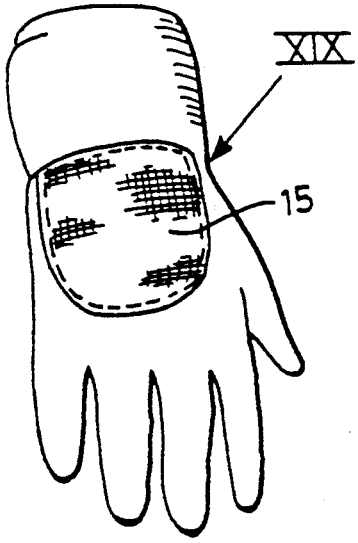
Figure 9:
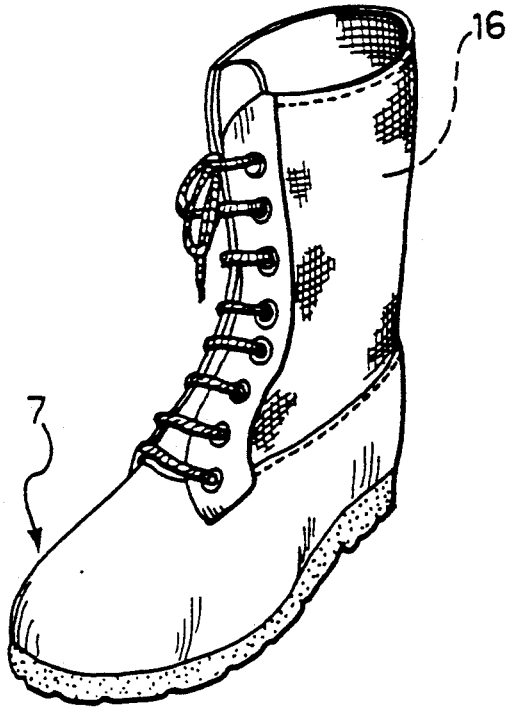
FIGS. 9 and 10 show a boot which forms part of the outfit according to the invention.
Figure 10:
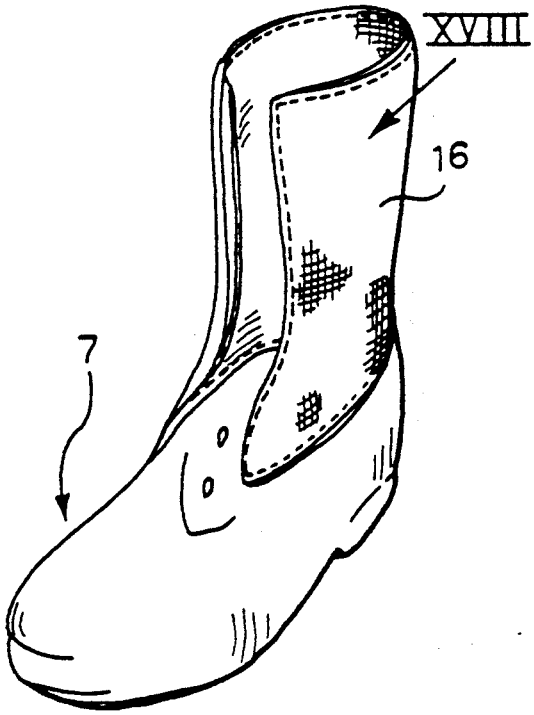
Figure 11:
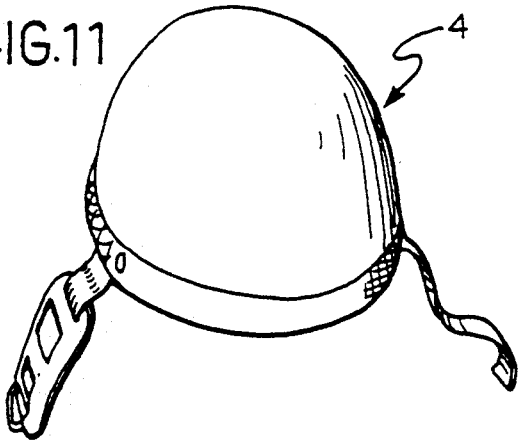
FIGS. 11 and 12 show the helmet which forms part of the outfit according to the invention.
Figure 19:
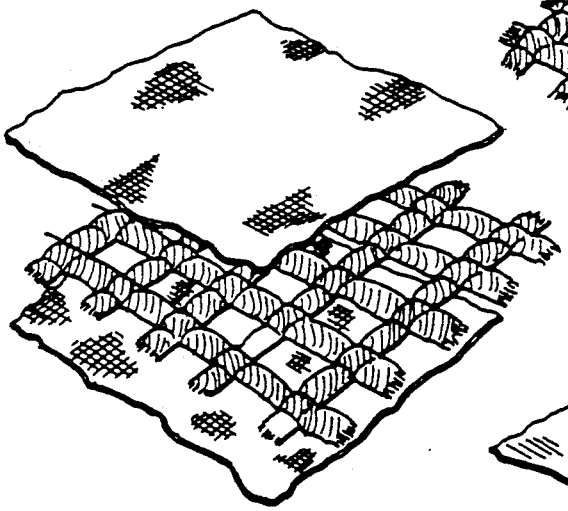
Figure 20:
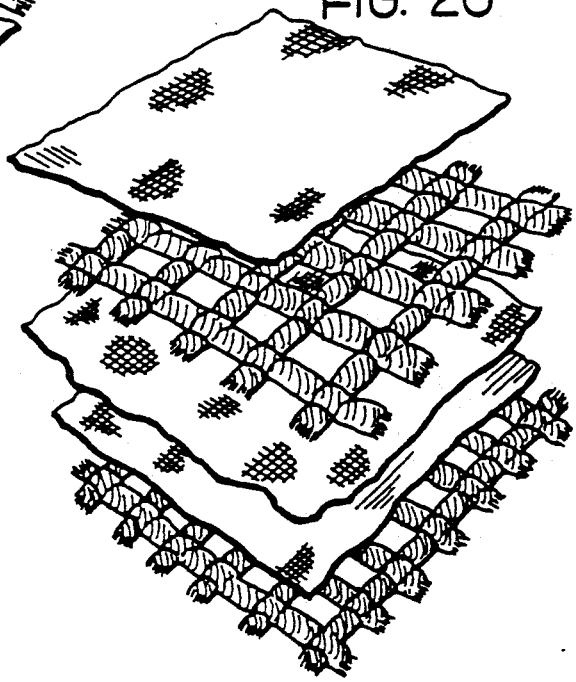

With reference to FIG. 6, most of the hood 3 is constituted by a single mesh layer of the type shown in FIG. 17 but it has a reinforced structure of the type shown in FIG. 19 over the ears and in the region of the face immediately in front of the ears (indicated 14).

With reference to FIGS. 7, 8, 9 and 10, the gloves 6 and the boots 7 also have greater protection with the structure shown in FIG. 19 in regions 15 on the backs of the hands (shown in FIG. 8) and with the structure shown in FIG. 18 in regions 16 around the ankle (shown in FIG. 10), respectively.

Figure 12:
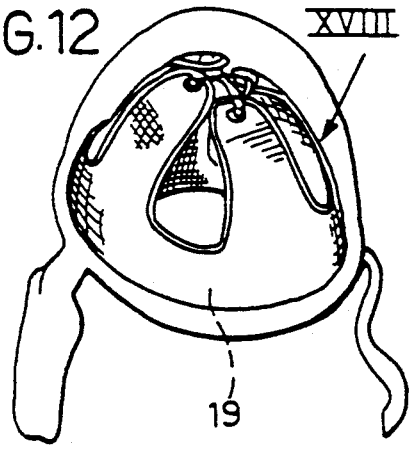
Figure 13:
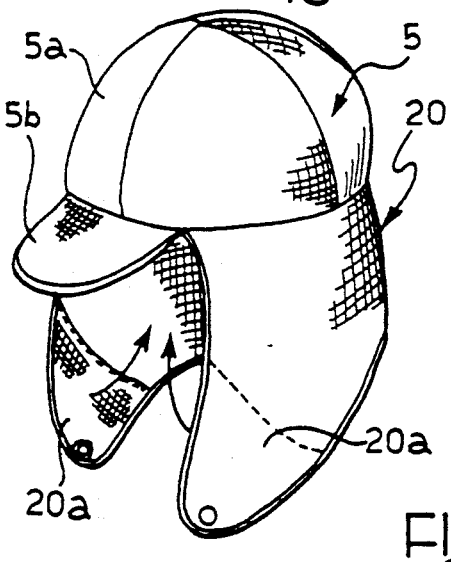
FIGS. 13–16 show a cap which also forms part of the outfit of the invention.
Figure 14:
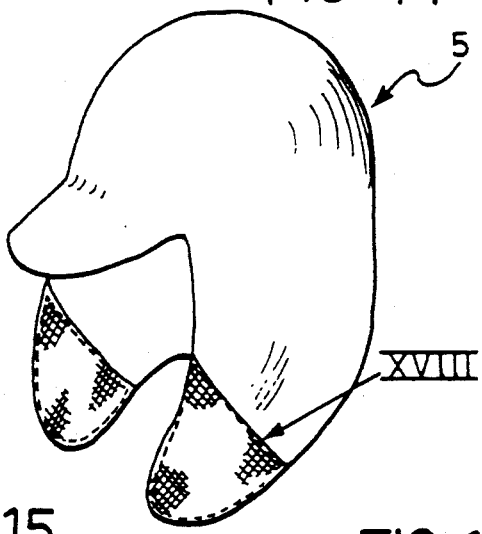
Figure 15:
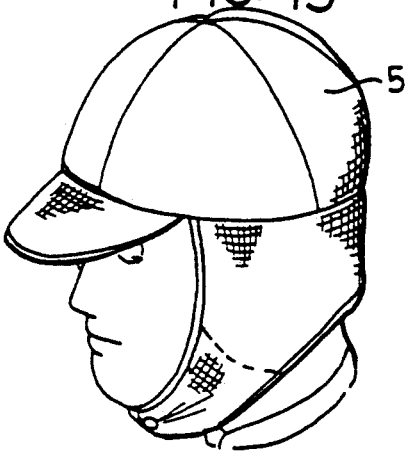
Figure 16:
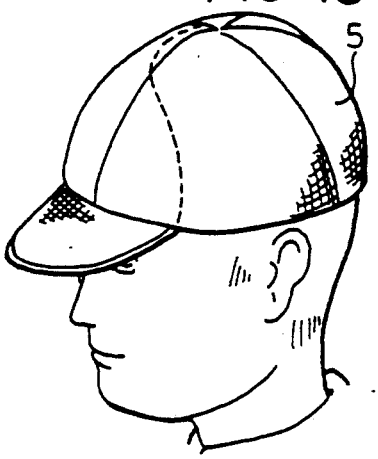

The helmet 4 has a protective lining 19 (FIG. 12) with the structure shown in FIG. 18.

The cap 5 includes a fabric hat part **5*a* with a peak 5*b* and a lower flap 20 for protecting the nape of the neck, the ears, the cheeks and the throat, including two parts 20*a* which can be closed under the chin and an additional protector (see arrow XVIII in FIG. 14) which has the structure shown in FIG. 18. The cap 5 is worn in the manner shown in FIG. 15 or in the manner shown in FIG. 16 with the flap 20** folded into the cap.

Naturally, the principle of the invention remaining the same, the details of embodiment may be varied widely with respect to those described and illustrated in the appended drawings, in dependence on the specific conditions of use.

What is claimed is:

1. A protective fireproof outfit for activities involving a risk of burns comprising at least one garment constructed of an outer layer of fireproof fabric and at least one mesh liner portion of fireproof yarn secured inside said garment in a selected region requiring greater protection, said layers being highly permeable to air to facilitate the transfer of heart from the outside environment to the skin of the person wearing the outfit by radiation while minimizing the transfer of heat by conduction and wherein said mesh liner has at least one aperture in correspondence with a heat resistant region of a body of a person wearing the garment to define a point where the outside temperature can be detected so that the person can become aware of the ambient temperature promptly.

2. A protective fireproof outfit as set forth in claim 1, wherein said garment in an overall garment having a body portion, leg portions with respective knee portions and arm portions having respective elbow portions, each of said leg portions having a liner portion substantially coextensive therewith sewn therein and at least one layer of net material made of fireproof yarn secured to said liner portions in said leg portions adjacent said knee portions.

3. A protective fireproof outfit as set forth in claim 2, further comprising an undershirt constituted by a single mesh layer with at least one additional mesh layer and at least one additional net layer secured therein in a selected location requiring greater protection with each layer being highly permeable to the passage of air.

4. A protective fireproof outfit as set forth in claim 3, further comprising a hood having eye aperture means therein cooperating with said undershirt to provide complete coverage of a neck region of a person wearing the outfit wherein said hood is constituted by a single mesh layer with at least one additional mesh layer and at least one additional net layer secured therein in a selected location requiring greater protection with each layer being highly permeable to the passage of air.

* * * * *